US005370065A

United States Patent [19]

Christensen

[11] Patent Number: 5,370,065

[45] Date of Patent: Dec. 6, 1994

[54] METHOD OF BURNING A PARTICULATE FUEL AND USE OF THE METHOD FOR BURNING SLUDGE

[75] Inventor: Jorgen S. Christensen, Farum, Denmark

[73] Assignee: Atlas Industries A/S, Ballerup, Denmark

[21] Appl. No.: 98,388

[22] PCT Filed: Feb. 6, 1992

[86] PCT No.: PCT/DK92/00039

§ 371 Date: Aug. 12, 1993

§ 102(e) Date: Aug. 12, 1993

[87] PCT Pub. No.: WO92/14969

PCT Pub. Date: Sep. 3, 1992

[30] Foreign Application Priority Data

Feb. 15, 1991 [DK] Denmark ..... 272/91

[51] Int. Cl.[5] ..... F23G 7/04

[52] U.S. Cl. ..... 110/346; 110/238; 110/264; 110/347; 110/259

[58] Field of Search ..... 110/238, 264, 346, 347, 110/259

[56] References Cited

U.S. PATENT DOCUMENTS

| | | | |
|---|---|---|---|
| 4,584,948 | 4/1986 | Syred et al. | 110/264 |
| 4,867,079 | 9/1989 | Shang et al. | 110/264 |
| 5,000,098 | 3/1991 | Ikeda et al. | 110/238 |
| 5,052,312 | 10/1991 | Rackley et al. | 110/346 |

*Primary Examiner*—Edward G. Favors

*Attorney, Agent, or Firm*—Antonelli, Terry, Stout & Kraus

[57] ABSTRACT

Method for producing hot drying gas by a burning flowable biological refuse in an incinerator which comprises a vertical cyclone furnace. Fuel together with primary combustion air is tangentially injected into the vertical cyclone furnace, and secondary combustion air and tertiary combustion air are injected into a throat. A cooled rotating ash scrapper is provided in the bottom of the vertical cyclone furnace and waste gas is conducted through the throat to a secondary combustion chamber in which an incineration of residuals takes place and from which a drying gas is removed. A combustion retarding gas is injected into the hottest area of the vertical cyclone furnace so that a sintering and the formation of slag is avoided.

11 Claims, 1 Drawing Sheet

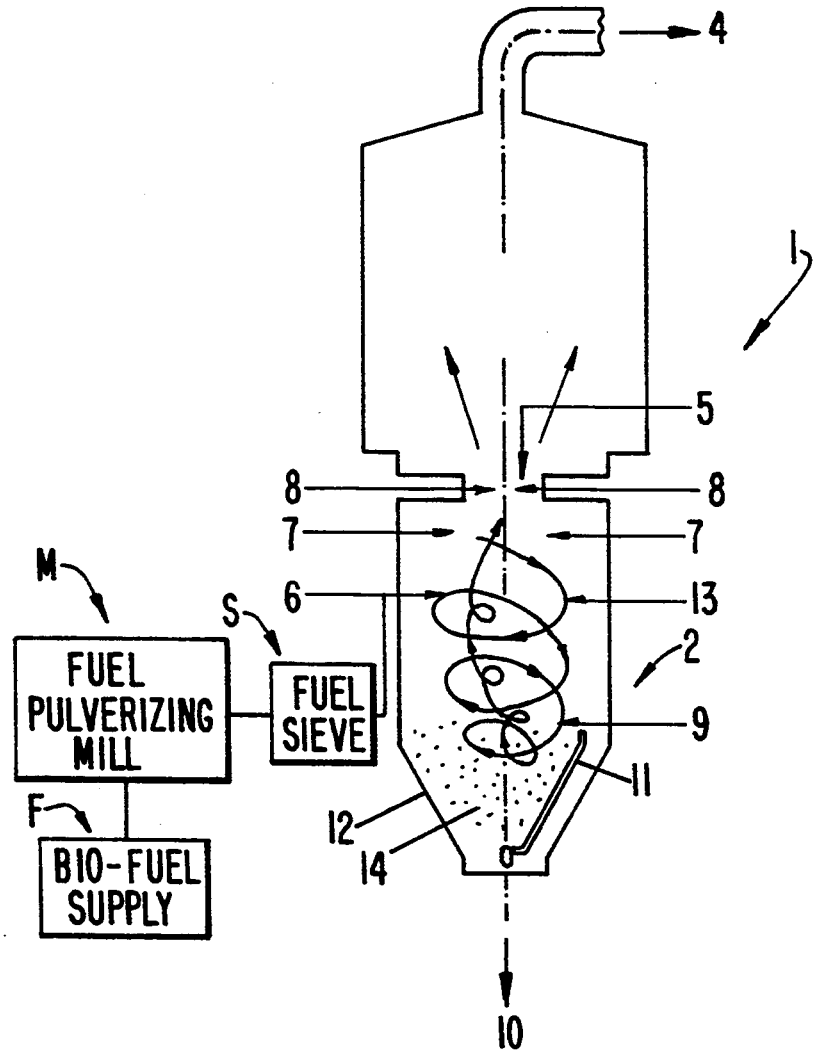
4
1
5
8
8
7
7
M
6
13
S
2
FUEL PULVERIZING MILL
FUEL SIEVE
9
11
F
12
14
BIO-FUEL SUPPLY
10

METHOD OF BURNING A PARTICULATE FUEL AND USE OF THE METHOD FOR BURNING SLUDGE

FIELD OF THE INVENTION

The present invention relates to a method for production of hot drying gases by incineration of fuel consisting of flowable biological refuse in an incinerator comprising a primary combustion chamber in the form of the vertical cyclone furnace.

BACKGROUND OF THE INVENTION

In vertical cyclone furnaces, fuel may be injected tangentially in an upper half of the vertical cyclone furnace together with primary combustion air, and secondary combustion air may be tangentially injected in the same plane as that at which the primary combustion air is injected or higher in the primary combustion chamber. Ash is generally removed from a bottom area of the furnace by a rotating cooled ash scrapper, and waste gas is transferred through an aperture in a top of the vertical cyclone furnace to a secondary combustion chamber.

In, for example, U.S. Pat. No. 4,398,477, two combustion chambers are provided which consist of two cyclone furnaces arranged one above the other and connected through an opening with a reduced clearance, a so-called throat. The fuel, which consists of rice hulls, is blown together with the primary air in the lower vertical cyclone furnace, and the waste gas is then burned in the upper cyclone furnace during the introduction of additional combustion air through tangential nozzles. Through this arrangement an optimal incineration of the fuel is achieved, and the residual product in the form of ash can be removed from the bottom lower cyclone furnace by a cooled rotating ash scrapper.

In order to achieve optimal incineration of the fuel, the temperature in the lower furnace is on the order of 1200° C. Such a high temperature is unfavorable in that, during combustion of biological fuels at this temperature, relatively large amounts of poisonous nitrogen oxides (NOx) are formed.

In WO90/05272, a sludge drying apparatus is proposed wherein, for example, sewage sludge is dried down to less than 10% water content in a rotating dryer, after which the dried sludge is used as fuel in a furnace which delivers the thermal energy necessary for the rotating dryer. However, it has proven to be almost impossible to incinerate the dried sludge in a normal cyclone furnace, with the reason being that the dried sludge and similar types of fuel vitrify to form a type of slag filled with porous pores which have an insulating effect, while, at the same time, the slag is highly viscous, thus rendering the removal of the slag impossible. Therefore, use is made in practice of other types of furnaces, for example, fluid-bed ovens, for the incineration of fuels which are aqueous or low energy content, such as, for example, dried biological sludge. Furnaces of such a type are suitable only for large amounts of fuel and require a long start-up time, and thus furnaces of this type are not suitable if they cannot be used in a continuous operation. Moreover, this type of furnace demands a comprehensive process regulation by specially-trained personnel.

Consequently, when it is necessary to dispose of refuse from smaller towns or urban areas, it is necessary to either use other methods of the disposal of the biological sludge or to transport the sludge to larger communal plants for incineration.

SUMMARY OF THE INVENTION

In accordance with the present invention, a method for the production of hot drying gas by incineration of fuel consisting of flowable biological refuse in an incinerator comprising a primary combustion chamber in the form of a vertical cyclone furnace includes tangentially injecting fuel in an upper half of the vertical cyclone furnace together with the primary combustion air, and tangentially injecting secondary combustion air in the same plane as that at which the primary combustion air is injected or higher in the primary combustion chamber. Ash is removed from a bottom area of the furnace by a rotating ash scrapper, and the waste gas is transferred through a reduced aperture in a top of the vertical cyclone furnace to a secondary combustion chamber. A combustion retarding gas is tangentially injected into the ash separation area of the vertical cyclone furnace.

By virtue of the above noted features of the present invention, it is possible to use a cyclone furnace for the incineration of dried flowable biological refuse of the type which cannot otherwise be burned in a cyclone furnace. The cyclone furnace has the great advantage that it is relatively inexpensive to produce, that it is compact and results in an intensive combustion, and, most importantly, the cyclone furnace is quick and easy to start up. Consequently, cyclone furnace for the incineration of biological refuse does not need to operate continuously.

By arranging and controlling a furnace in accordance with the present invention, it is possible to burn biofuels of low calorific value without the fuel sintering, which gives rise to the formation of slag and sintering the combustion zone. The combustion zone usually lies slightly below a middle of the furnace, with the reason being that the fuel will not ignite until the fuel has reached a good distance downwardly toward the bottom and has achieved the ignition temperature. The introduction of combustion-retarding gas to the ash separation area, for example, oxygen-deficient air in the form of wet flue gas, will retard combustion so that this is less intense, and the sintering formation is avoided. At the same time, a reduction in the formation of $NO_x$ is achieved because the surplus air is decreased and, providing that the temperature is about 850° C., the CO formation can be held at an acceptably low level.

The waste gas formed by the controlled and retarded combustion is burned after the throat in a secondary combustion chamber which is merely a large, brick-lined chamber in which the post-combustion takes place. In order to burn out the flue gas from the retarded combustion, it is necessary for the secondary combustion chamber to be of a sufficient size for the reduction of the CO content in the waste gas, and to provide the waste gas with an adequate period of time in the secondary combustion of, for example, 0.5–2 seconds.

In accordance with the present invention, tertiary combustion air is injected tangentially and directly into the reduced aperture and secondary combustion air is injected immediately below the reduced aperture, with the injections being effected with relatively high air velocity, whereby sintering and the formation of slag at the throat is avoided, even during the use of dried biological sludge with low ash content. Moreover, a particularly good ash separation is achieved if the diameter of the throat is small relative to the diameter of the cyclone combustion furnace, for example, a diameter which is less than one-half of the diameter of the cyclone furnace, and if the air velocity is around 60–100 m/sec.

In accordance with the present invention, an amount of the combustion-retarding gas injected constitutes at least 10% of a total amount of air injected into the vertical cyclone furnace, and is on the order of about one-half of an amount of the primary combustion air, so that it can be ensured that no sintering of the fuel with slag formation can occur at any place within the combustion area in the cyclone furnace. All ash/slag will fall to the bottom in the conical area of the furnace, where by a cooled rotating ash scrapper, the ash/slag can be removed from the furnace in the normal manner, for example, by an ash sluice.

According to the invention, a flowable fuel is used, with the fuel being pulverized and screened so that at least 75% of the fuel has a particle size of less than 1 mm, and a maximum particle size of 5 mm. By virtue of these last noted features, the operational reliability of the furnace is increased so that a uniform and complete incineration of the fuel is achieved. The fuel is measured and screened so that it has the desired particle distribution. The smallest particles are ignited quickly and ensure the combustion, while the large particles are held by the centrifugal force in the periphery of the primary chamber until combustion has taken place.

If a poor fuel is used, for example, fuel with a high ash content or high water content, a subsidiary firing with an oil or gas injection into the secondary combustion air must be employed especially if the calorific value of the fuel is less than 1700 kcal/kg. The subsidiary firing plant can be used in connection with the start-up of the combustion furnace. However, when the fuel has a calorific value of about 1700 kcal/kg or higher, it is possible to maintain a constant combustion of the fuel without any subsidiary firing.

Advantageously, according to the present invention, the secondary combustion chamber has a volume which is at least sufficient for the waste gases to exist therein for at least 0.5 sec. by this construction, a complete combustion of the waste gas is achieved so that the CO content is burned to $CO_2$, and a suitably low CO content is achieved without any significant formation of $NO_x$.

In order to ensure that the sintering of the fuel cannot take place at any point in the furnace during combustion and at no point in the furnace is there any formation of viscous slag, according to the invention, the injection of combustion air and the combustion-retarding gas is effected in such a manner that the temperature does not exceed 950°–1000° C. at any point in the vertical cyclone furnace. The combustion throughout the entire primary combustion chamber is a so-called dry or non-slagging combustion, with the only waste products being ash and flue gas, and, where the ash is of such a consistency that it can be removed without problems by a commonly known rotating ash scrapper.

It has been experimentally determined in connection with the burning of fuel which consists solely of biological refuse in the form of dried sludge, the best incineration of the fuel is achieved when an amount of the injected combustion-retarding gas is on the order of about one-half of an amount of the primary combustion air, and an amount of the secondary combustion air is of the same order as the amount of the primary combustion air.

The method of the present invention may be used for the incineration in the vertical cyclone combustion furnace of biological sludge with a water content of less than 25%, with a hot drying gas being used for predrying the biological sludge in a drying plant. Moist drying air from the drying plant may be recirculated to the incinerator and used as the combustion-retarding gas in the vertical cyclone furnace.

Moreover, the method of the present invention may be used in an arrangement where the vertical cyclone combustion furnace is arranged in a drying plant for aqueous masses such as, for example, biological sludge in a manner more fully described in connection with WO90/05272.

However, as can well be appreciated, the method of the present invention can naturally be used in connection with the burning of other forms of biological fuel.

BRIEF DESCRIPTION OF THE DRAWING

The method of the present invention will now be described in more detail with reference to the accompanying drawing, wherein:

The Single Figure of the drawing is a schematic view of an incinerator including a vertical cyclone furnace connected to a secondary combustion chamber via a throat constructed in accordance with the present invention.

DESCRIPTION OF PREFERRED EMBODIMENTS

As shown in the Single Figure of the drawing, according to the present invention, an incinerator for bio-fuels, for example, dried sludge, comprises a primary combustion chamber in the form of a vertical cyclone furnace 2, a throat 5 and a secondary combustion chamber for subsequent incineration of the waste gas from the cyclone furnace 2.

In the bottom of the conical part 12 of the cyclone furnace there is provided a rotating ash scraper 11 which is air-cooled in the normal manner, and which scrapes the ash 14 out through a not-shown ash sluice 10 or an ash conveyor with product lock.

The top of the secondary chamber 3 is arranged for the removal of the hot waste gas 4, which, for example can be used directly in a rotary drier as described in more detail in International Patent Application No. PCT/DK89/00246 (W090/05272), and to which reference is made to all extent in connection with the use of the hot drying gas 4.

The primary air/fuels 6 is blown in through tangential injection nozzles. The fuel is bio-fuel, e.g. dried sludge, supplied from a source F as explained in more detail in the above-mentioned international application. The dried bio-fuel in the form of sludge is dried down to less than 15%, preferably 10%, water content, pulverized in a mill M and screened through, for example a 5 mm sleeves. The main part of the fuel, for example, at least 75%, has a particle size of less than 1 mm, and the maximum particle size due to the sieve is 5

At the same level, or possibly slightly above in the cyclone furnace than that at which the primary air is injected, the secondary air 7 is injected through a series of tangential nozzles, and tertiary air 8 is blown into the throat 5 itself, similarly through a number of tangential nozzles. A modest amount of combustion air is also injected through the cooled ash scraper 11, in that cooling-air is introduced into the combustion chamber through openings in the ash scraper 11.

At some distance down in the cyclone furnace, preferably at around the mid-point or immediately below, the injected air/ fuel 6 will be ignited and will burn. In order to control and dampen the intensity of the combustion, so that the fuel does not sinter and give rise to the formation of slag in the combustion zone, combustion-retarding gas 9 is injected directly into the combustion zone via tangential nozzles in the direction of rotation for the combustion.

The combustion-retarding gas is air with reduced oxygen content and/or with high moisture content, so that the oxygen content of the air is reduced approx. 30–50% in relation to normal atmospheric air, and the air has a temperature in on the order of 100°–200° C., preferably 150° C. The air, for example, is recirculated drying air with a temperature of approx. 150° C. from the rotary dryer in the above-mentioned international application. The amount of combustion-retarding air 9 can be set once and for all, depending on the capacity of the furnace. Primary air, secondary air and tertiary air is also set once and for all, similarly depending on the capacity of the furnace. The temperature of the furnace is controlled at approx. 850° C. If the temperature falls, the amount of injected fuel is increased. If the temperature rises, the amount of injected fuel is reduced. There is hereby achieved a very simple and reliable form of control, which at the same time ensures that the temperature does not exceed 950°–1000° C. at any point in the primary chamber.

With an incinerator of the type described, and controlled as explained above, a cyclone combustion 13 is achieved whereby with the use of gravitation and the special form of injection for the combustion air, the combustion takes place in a downwardly-directed spiral movement as shown in the drawing, and where the waste gas, similarly sketched in the drawing, is transferred via the throat 5 to the post-combustion chamber 3 for incineration. The post-combustion chamber 3 is at least of the same size as the cyclone furnace, but will normally have a volume which ensures that the period of time for which the waste gases are in the chamber is at least 0.5 seca.

The following table shows a series of different values for incinerators controlled according to the invention and used in connection with recirculated waste gas (drying air) and biological fuel from a rotary dryer as disclosed in the above-mentioned international application.

| Type | 30–190 |
|---|---|
| Evaporation kg/h | 500–3,200 |
| Person equivalents | 30,000–190,000 |
| Wet sludge t/week | 63–400 |
| Ash t/week | 6–36 |
| Furnace effect MW | 0.5–2.8 |
| Primary air % | 30 |
| Secondary air % | 30 |
| Tertiary air % | 15 |
| Scraper air % | 10 |
| Recirculated air %**) | 15 |
| Waste gas %*) | 100 |

Prerequisites: 60 g solids per person equivalent per 24 hours; the dried sludge has 20% solids, of which 40% is ash. Operational time per week is 100 h.
*)This drying air, which, for example, is used in a rotary dryer as disclosed in the above-mentioned international application, has a temperature of approx. 850° C. and a NOx content of less than 100 ppm.
**)The air has a temperature of 100–150° C., an oxygen content of 10–12% and a moisture content of 0.4 kg water per kg dry air.

At the start-up of the incinerator, oil or gas, for example, N-gas, is introduced in the secondary air 7 by nozzles. These nozzles (not shown) are also used for subsidiary firing if the fuel has a calorific value of less than 1700 kcal/kg.

What is claimed is:

1. Method for production of hot drying gas by incineration of fuel consisting of flowable biological refuse in an incinerator comprising a primary combustion chamber in the form of a vertical cyclone furnace, the method comprising the steps of:

tangentially injecting the fuel in an upper half of the vertical cyclone furnace together with primary combustion air, tangentially injecting secondary combustion air in the same plane as that at which the primary combustion air is injected or higher in the primary combustion chamber, removing ash from a bottom area of the furnace by a rotating cooled ash scrapper, transferring waste gas through a reduced aperture in a top of the vertical cylindrical furnace to a secondary combustion chamber, and tangentially injecting combustion-retarding gas into an ash separation area of the vertical cyclone furnace.

2. Method according to claim 1, further comprising the step of injecting tertiary combustion air tangentially and directly into the reduced aperture, and injecting the secondary combustion air immediately below the reduced aperture, wherein said injections are effected with relatively high air velocity.

3. Method according to one of claims 1 or 2, wherein an amount of said combustion-retarding gas injected constitutes at least 10% of a total amount of air injected into the vertical cyclone furnace, and is on the order of one-half of an amount of said primary combustion air.

4. Method according to claim 3, wherein the fuel is a flowable fuel, and wherein the fuel is pulverized and screened so that a least 75% of the fuel has a particle size of less than 1 mm, and a maximum particle size of 5 mm.

5. Method according to claim 4, further comprising the step of effecting a subsidiary firing with oil or gas injection into the secondary combustion air if a calorific value of the fuel is less than 1700 kcal/kg.

6. Method according to claim 1, wherein the secondary combustion chamber has a volume at least sufficient for the waste gases to exist therein for at least 0.5 sec.

7. Method according to one of claims 1 or 2, wherein the injection of combustion air and combustion-retarding gas is effected in such a manner that the temperature does not exceed 950°–1000° C. at any point in the vertical cyclone furnace.

8. Method according to one of claims 1 or 2, wherein an amount of injected combustion-retarding gas is on the order of about one-half of an amount of primary combustion air, and wherein an amount of the secondary combustion air is of the same order as the amount of the primary combustion air.

9. A method according to one of claims 1 or 2, wherein the vertical cyclone combustion furnace incinerates biological sludge with a water content of less than 25%, hot drying gas is used for a predrying the biological sludge in a drying plant, and wherein moist drying air from the drying plant is recirculated to the incinerator and is used as the combustion-retarding gas in the vertical cyclone furnace.

10. Method according to one of claim 1 or 2, wherein the vertical cyclone furnace is arranged in a drying plant for aqueous masses.

11. Method according to claim 10, wherein the aqueous masses include biological sludge.

* * * * *